US010690136B2

(12) United States Patent
Wirth et al.

(10) Patent No.: US 10,690,136 B2
(45) Date of Patent: Jun. 23, 2020

(54) SUPERCHARGED INTERNAL COMBUSTION ENGINE WITH COMPRESSOR

(71) Applicant: Ford Global Technologies, LLC, Dearborn, MI (US)

(72) Inventors: Martin Wirth, Remscheid (DE); Vanco Smiljanovski, Bedburg (DE); Jan Linsel, Cologne (DE); Frank Kraemer, Neunkirchen-Seelscheid (DE); Carsten Weber, Leverkusen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 236 days.

(21) Appl. No.: 15/798,264

(22) Filed: Oct. 30, 2017

(65) Prior Publication Data

US 2018/0128274 A1 May 10, 2018

(30) Foreign Application Priority Data

Nov. 4, 2016 (DE) ..... 10 2016 221 638
Nov. 4, 2016 (DE) ..... 10 2016 221 639

(51) Int. Cl.

| | |
|---|---|
| ***F04D 17/08*** | (2006.01) |
| ***F04D 29/58*** | (2006.01) |
| ***F04D 29/28*** | (2006.01) |
| ***F04D 29/051*** | (2006.01) |
| ***F04D 25/06*** | (2006.01) |
| ***F04D 25/02*** | (2006.01) |

(52) U.S. Cl.

CPC ..... *F04D 17/08* (2013.01); *F04D 25/024* (2013.01); *F04D 25/06* (2013.01); *F04D 29/051* (2013.01); *F04D 29/0513* (2013.01); *F04D 29/284* (2013.01); *F04D 29/582* (2013.01); *F04D 29/5806* (2013.01)

(58) Field of Classification Search

CPC ..... F04D 17/08; F04D 25/024; F04D 25/06; F04D 29/051; F04D 29/0513; F04D 29/284; F04D 29/5806; F04D 29/582

USPC ..... 415/116

See application file for complete search history.

(56) References Cited

U.S. PATENT DOCUMENTS

| | | | | |
|---|---|---|---|---|
| 3,829,235 A | | 8/1974 | Woollenweber, Jr. | |
| 5,583,906 A | * | 12/1996 | Sugiura | H01J 9/42 378/132 |
| 5,605,045 A | | 2/1997 | Halimi et al. | |
| 8,491,271 B2 | | 7/2013 | Jennes et al. | |
| 9,003,793 B2 | | 4/2015 | Begin et al. | |

(Continued)

FOREIGN PATENT DOCUMENTS

| | | |
|---|---|---|
| DE | 102010053497 A1 | 6/2012 |
| DE | 102015007379 A1 | 1/2016 |

(Continued)

*Primary Examiner* — Joseph J Dallo
*Assistant Examiner* — Yi-Kai Wang
(74) *Attorney, Agent, or Firm* — Geoffrey Brumbaugh; McCoy Russell LLP

(57) ABSTRACT

Methods and systems are provided for a turbocharger. In one example, the turbocharger may include one or more cooling devices for cooling a compressor. The cooling devices may include a ventilation system arranged in a compressor impeller and shaft, the ventilation system configured to allow ambient air to flow into the shaft without being compressed.

17 Claims, 6 Drawing Sheets

(56) References Cited

U.S. PATENT DOCUMENTS

| | | | | |
|---|---|---|---|---|
| 2003/0147302 | A1* | 8/2003 | Uesugi | B01F 3/0807 366/164.6 |
| 2005/0257522 | A1 | 11/2005 | Fremerey et al. | |
| 2006/0248887 | A1 | 11/2006 | Arnold | |
| 2007/0266705 | A1* | 11/2007 | Wood | F02B 37/22 60/599 |
| 2010/0111725 | A1* | 5/2010 | Knoop | F04D 29/0513 417/372 |
| 2012/0003081 | A1 | 1/2012 | Woollenweber | |
| 2015/0252689 | A1 | 9/2015 | Burmester et al. | |
| 2015/0322958 | A1 | 11/2015 | Date et al. | |

FOREIGN PATENT DOCUMENTS

| | | | |
|---|---|---|---|
| EP | 2573317 | A1 | 3/2013 |
| KR | 20050071093 | A | 7/2005 |
| WO | 2007056780 | A1 | 5/2007 |

* cited by examiner

SUPERCHARGED INTERNAL COMBUSTION ENGINE WITH COMPRESSOR

CROSS REFERENCE TO RELATED APPLICATION

The present application claims priority to German Patent Application No. 102016221638.4, filed Nov. 4, 2016 and German Patent Application No. 102016221639.2, filed Nov. 4, 2016. The entire contents of the above-referenced applications are hereby incorporated by reference in their entirety for all purposes.

FIELD

The present description relates generally to a turbocharger having a cooling arrangement to decrease a compressed air temperature.

BACKGROUND/SUMMARY

An internal combustion engine of the type mentioned in the introduction may be used as a motor vehicle drive. Within the context of the present disclosure, the expression "internal combustion engine" encompasses diesel engines and Otto-cycle engines and also hybrid internal combustion engines, which utilize a hybrid combustion process, and hybrid drives which comprise not only the internal combustion engine but also an electric machine which can be connected in terms of drive to the internal combustion engine and which receives power from the internal combustion engine or which, as a switchable auxiliary drive, additionally outputs power.

In recent years, there has been a trend in development toward supercharged engines, wherein the economic significance of said engines for the automobile industry continues to steadily increase.

Supercharging is primarily a method for increasing power in which the air needed for the combustion process in the engine is compressed, as a result of which a greater air mass can be fed to each cylinder in each working cycle. In this way, the fuel mass and therefore the mean pressure can be increased.

Supercharging is a suitable means for increasing the power of an internal combustion engine while maintaining an unchanged swept volume, or for reducing the swept volume while maintaining the same power. In any case, supercharging leads to an increase in volumetric power output and a more expedient power-to-weight ratio. If the swept volume is reduced, it is thus possible to shift the load collective toward higher loads, at which the specific fuel consumption is lower. By means of supercharging in combination with a suitable transmission configuration, it is also possible to realize so-called downspeeding, with which it is likewise possible to achieve a lower specific fuel consumption.

Supercharging consequently assists in the constant efforts in the development of internal combustion engines to minimize fuel consumption, that is to say to improve the efficiency of the internal combustion engine.

For supercharging, use may made of an exhaust-gas turbocharger, in which a compressor and a turbine are arranged on the same shaft. The hot exhaust-gas flow is fed to the turbine and expands in the turbine with a release of energy, as a result of which the shaft is set in rotation. The energy released by the exhaust-gas flow to the turbine and ultimately to the shaft is used for driving the compressor which is likewise arranged on the shaft. The compressor conveys and compresses the charge air fed to it, as a result of which supercharging of the cylinders is obtained. A charge-air cooler may be arranged in the intake system downstream of the compressor, by means of which charge-air cooler the compressed charge air is cooled before it enters the at least one cylinder. The cooler lowers the temperature and thereby increases the density of the charge air, such that the cooler also contributes to improved charging of the cylinders, that is to say to a greater air mass. Additional compression by cooling may take place.

The difference between an exhaust-gas turbocharger in relation to a supercharger—which can be driven by means of an auxiliary drive—consists in that an exhaust-gas turbocharger utilizes the exhaust-gas energy of the hot exhaust gases, whereas a supercharger draws the energy needed for driving it directly or indirectly from the internal combustion engine and thus adversely affects, that is to say reduces, the efficiency, at least for as long as the drive energy does not originate from an energy recovery source. Thus, the efficiency and/or overall power output of the turbocharger may be greater than the supercharger.

If the supercharger is not one that can be driven by means of an electric machine, that is to say electrically, a mechanical or kinematic connection for power transmission is generally needed between the supercharger and the internal combustion engine, which also influences the packaging in the engine bay.

The benefit of a supercharger in relation to an exhaust-gas turbocharger consists in that the supercharger can generate, and make available, the desired charge pressure at a greater range of times, specifically regardless of the operating state of the internal combustion engine. This applies in particular to a supercharger which can be driven electrically by means of an electric machine, and is therefore independent of the rotational speed of the crankshaft. For example, the supercharger may provide charge pressure during transient conditions where the turbocharger may lag.

In previous examples, it is specifically the case that difficulties are encountered in achieving an increase in power in all engine speed ranges by means of exhaust-gas turbocharging. A relatively severe torque drop is observed in the event of a certain engine speed being undershot. Said torque drop is understandable if one takes into consideration that the charge pressure ratio is dependent on the turbine pressure ratio or the turbine power. If the engine speed is reduced, this leads to a smaller exhaust-gas mass flow and therefore to a lower turbine pressure ratio or a lower turbine power. Consequently, toward lower engine speeds, the charge pressure ratio likewise decreases. This equates to a torque drop.

The internal combustion engine to which the present disclosure relates has a compressor for supercharging purposes, wherein, in the context of the present disclosure, both a supercharger that can be driven by means of an auxiliary drive and a compressor of an exhaust-gas turbocharger can be subsumed under the expression "compressor".

An issue in the case of supercharging is that the charge air heats up during the compression in the compressor, whereby the efficiency of the compression deteriorates. The compressed hot charge air is duly generally cooled downstream of the compressor in a charge-air cooler of the intake system to ensure an improved cylinder charge. That is to say, compression by cooling may occur, thereby allowing more compressed air to flow to each cylinder of the engine if desired. However, owing to the operating principle, said charge-air cooling has no influence on the compression of the charge air in the compressor that is performed upstream.

To reduce or eliminate efficiency losses during the compression, compressors according to previous examples are cooled. In general, the compressor housing may be equipped with at least one coolant jacket to form the cooling arrangement. Either the housing is a cast part, wherein a coolant jacket is formed as an integral constituent part of a monolithic housing during the course of the casting process, or said housing is of modular construction, wherein during the course of the assembly process, a cavity is formed which serves as coolant jacket.

From the previous examples, concepts are known in which a coolant jacket is provided in the outlet region of the compressor, and concepts are also known in which the coolant jacket follows the contour of the impeller. Both concepts are unsuitable for effectively cooling the charge air during the compression in the compressor and for ensuring as isothermic a compression as possible and thereby improving the efficiency of the compression.

Consequently, further or other measures may be desired to improve the efficiency of the compression in a supercharged internal combustion engine.

In one example, the issues described above may be addressed by a supercharged internal combustion engine having an intake system for the supply of a charge-air flow, an exhaust-gas discharge system for the discharge of exhaust gas, at least one compressor arranged in the intake system, which compressor comprises at least one impeller which is mounted, in a compressor housing, on a rotatable shaft, and a bearing housing for the accommodation and mounting of the rotatable shaft of the at least one compressor, which internal combustion engine further comprises that the rotatable shaft of the at least one compressor is equipped with a ventilation system which comprises at least one duct which is formed so as to be open to the intake system upstream of the at least one compressor and from which at least one line branches off which emerges from the shaft between the at least one compressor and the bearing housing. In this way, heat transfer from the turbine to the compressor is reduced and cooling to the compressor blades is increased.

As one example, the compressor of the internal combustion engine according to the present disclosure is air-cooled and has at least one ventilation system which is suitable for dissipating heat from the compressor and from the charge air situated in the compressor. For this purpose, the rotatable shaft of the compressor is equipped with at least one duct which is connected or at least connectable to the intake system upstream of the compressor and from which at least one line branches off which emerges into the surroundings.

The ventilation system according to the present disclosure is supplied by the duct with air from the intake system upstream of the compressor, wherein the air passes into the surroundings via lines which branch off from the duct. As it flows through the ventilation system, the air cools the shaft of the compressor. Here, in particular, the convection between the rotating shaft and the air flow is utilized for the heat transfer and the heat dissipation.

The air which heats up during the compression is to be regarded as a heat source, wherein the temperature difference between the hot air and the relatively cool or cooled compressor shaft drives the heat dissipation. According to the present disclosure, the heat is extracted from the compressor and the shaft by means of air as said air flows through, and said heat is dissipated to the surroundings by the ventilation system.

By means of the approach according to the present disclosure, the charge air can be cooled during the compression, wherein an isothermic compression is sought, which is distinguished by particularly high efficiency.

The internal combustion engine according to the present disclosure may be a supercharged internal combustion engine which is improved in relation to previous examples with regard to the efficiency of the compression of the charge air in the compressor. The object on which the present disclosure is based is thereby achieved and air is cooled during compression more than in the previous examples utilizing coolant jackets in the compressor housing or the like.

The concept according to the present disclosure for cooling the charge air is also distinguished by the fact that it is suitable for retrofitting of compressors already on the market. Said another way, the cooling arrangement of the present disclosure is relatively simple to introduce to current turbocharging systems and turbocharging systems already in use. Thus, the manufacture of the cooling arrangement is relatively simple compared to, for example, arranging a cooling jacket in the compressor housing.

The at least one impeller of the compressor may be fastened rotationally conjointly to the shaft.

Additional embodiments of the supercharged internal combustion engine will be discussed below.

Embodiments of the supercharged internal combustion engine may comprise in which the at least one duct opens into the intake system at a compressor-side end side of the shaft. Then, the at least one duct faces toward the charge-air inflow in the inlet region of the compressor, and the flow energy can be utilized for feeding air into the ventilation system and conveying said air through the ventilation system.

Embodiments of the supercharged internal combustion engine may comprise in which the at least one duct is of rectilinear form. A rectilinear form of the duct facilitates the manufacture of the duct, for example by means of drilling.

In this context, embodiments of the supercharged internal combustion engine may comprise in which the at least one duct runs coaxially with respect to the shaft or with respect to the axis of rotation of the shaft. Thus, air from the intake system may readily flow into the ventilation system without turning or deviating from an original direction of flow.

Embodiments of the supercharged internal combustion engine may comprise in which the at least one line is of rectilinear form. A rectilinear form of the line facilitates the manufacture of the line, for example by means of drilling.

In this context, embodiments of the supercharged internal combustion engine may comprise in which the at least one line runs perpendicular to the at least one duct. Then, when the shaft is in rotation, the centrifugal force acting on the air situated in the ventilation system can be utilized without hindrance for conveying the air in the ventilation system or out of the ventilation system. This is supplemented by a pump effect which results from the pressure gradient across the ventilation system. The higher the air throughput and thus the flow speed of the air in the ventilation system, the greater the amount of heat that is dissipated.

In this context, embodiments of the supercharged internal combustion engine may further comprise in which the at least one line is oriented radially outward. In one example, the at least one line functions as an outlet, expelling air out of the ventilation system and into a space in the turbocharger housing.

Embodiments of the supercharged internal combustion engine may comprise in which at least two lines are provided.

Embodiments of the supercharged internal combustion engine may comprise in which multiple lines are provided, but only one duct.

Embodiments of the supercharged internal combustion engine may comprise in which, furthermore, at least one disk-shaped element is arranged on the shaft, preferably at the compressor side. A disk-shaped element has a relatively large surface in contact with the surroundings, whereby the heat dissipation to the surroundings is increased or improved.

When the compressor is in operation, the disk-shaped element rotates with the rotating shaft, whereby the heat transfer from the disk to the surroundings may be assisted by convection.

Embodiments of the supercharged internal combustion engine may comprise in which the shaft has, at the impeller side, a thickened shaft end for accommodating the at least one impeller.

The thickened shaft end facilitates the introduction of heat or heat transfer from the impeller into the shaft and thus the heat dissipation from the charge air situated in the compressor. Furthermore, the thickened shaft end increases the strength of the shaft and allows for the fact that, according to the present disclosure, the shaft is equipped with a ventilation system, that is to say with cavities.

Embodiments of the supercharged internal combustion engine may comprise in which at least one compressor which can be driven by means of an auxiliary drive is arranged in the intake system.

A compressor which can be driven via an auxiliary drive, that is to say a supercharger, can generate and make available the desired charge pressure at a wide range of engine operating parameters, specifically independently of the operating state of the internal combustion engine. This applies in particular to a supercharger which can be driven electrically by means of an electric machine, and is therefore independent of the rotational speed of the crankshaft. For example, the supercharger may provide the desired boost during transient conditions where engine exhaust gas output may be too low to sufficiently drive a turbine.

In this context, embodiments of the supercharged internal combustion engine may comprise in which the at least one compressor of the internal combustion engine is a compressor which can be driven by means of an auxiliary drive.

Embodiments of the supercharged internal combustion engine may further comprise in which at least one exhaust-gas turbocharger is provided, which comprises a turbine arranged in the exhaust-gas discharge system and a compressor arranged in the intake system.

In this context, embodiments of the supercharged internal combustion engine may comprise in which the at least one compressor is the compressor of the at least one exhaust-gas turbocharger.

To be able to counteract a torque drop at low engine speeds, embodiments of the internal combustion engine may comprise in which at least two exhaust-gas turbochargers are provided. Specifically, if the engine speed is reduced, this leads to a smaller exhaust-gas mass flow and therefore to a lower charge-pressure ratio.

Through the use of multiple exhaust-gas turbochargers, for example multiple exhaust-gas turbochargers connected in series or parallel, the torque characteristic of a supercharged internal combustion engine may be increased.

To improve the torque characteristic, it is also possible, in addition to the at least one exhaust-gas turbocharger, for a further compressor, that is to say a compressor which can be driven by means of an auxiliary drive, to be provided.

Embodiments of the supercharged internal combustion engine may comprise in which the at least one impeller has a multiplicity of impeller blades to improve the heat dissipation.

Embodiments of the supercharged internal combustion engine may comprise in which the at least one compressor is a radial compressor. This embodiment permits dense packaging with regard to the supercharging arrangement. The compressor housing may be configured as a spiral or worm housing. In the case of an exhaust-gas turbocharger, the diversion of the charge-air flow in the compressor of the exhaust-gas turbocharger may be utilized for conducting the compressed charge air on the shortest path from the outlet side, on which the turbine of the exhaust-gas turbocharger is commonly arranged, to the inlet side.

In this connection, embodiments may comprise in which the turbine of the at least one exhaust-gas turbocharger is a radial turbine. This embodiment likewise permits dense packaging of the exhaust-gas turbocharger and thus of the supercharging arrangement as a whole.

By contrast to turbines, compressors are defined in terms of their exit flow. A radial compressor is thus a compressor whose flow exiting the rotor blades runs substantially radially. In the context of the present disclosure, "substantially radially" means that the speed component in the radial direction is greater than the axial speed component.

Embodiments of the supercharged internal combustion engine may further comprise in which the at least one compressor is of axial type of construction. The flow exiting the impeller blades of an axial compressor runs substantially axially.

Embodiments of the supercharged internal combustion engine may comprise in which the at least one compressor has an inlet region which runs coaxially with respect to the shaft of the at least one impeller and which is designed such that the flow of charge air approaching the at least one impeller runs substantially axially.

In the case of an axial inflow to the compressor, a diversion or change in direction of the charge-air flow in the intake system upstream of the at least one impeller is often omitted, whereby unnecessary pressure losses in the charge-air flow owing to flow diversion are avoided, and the pressure of the charge air at the inlet into the compressor is increased.

Embodiments of the supercharged internal combustion engine may comprise in which the ventilation system is equipped with a shut-off element which in the open state opens up, that is to say activates, the ventilation system and which in the closed state shuts off, that is to say deactivates, the ventilation system.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for a turbocharging system. The system comprises a compressor arranged in an intake system and a turbine arranged in an exhaust system. The compressor and turbine are rotatably coupled via a shaft extending therebetween. The shaft, compressor and turbine are shown in FIGS. 1, 3, 4, and 5.

Figure 1:
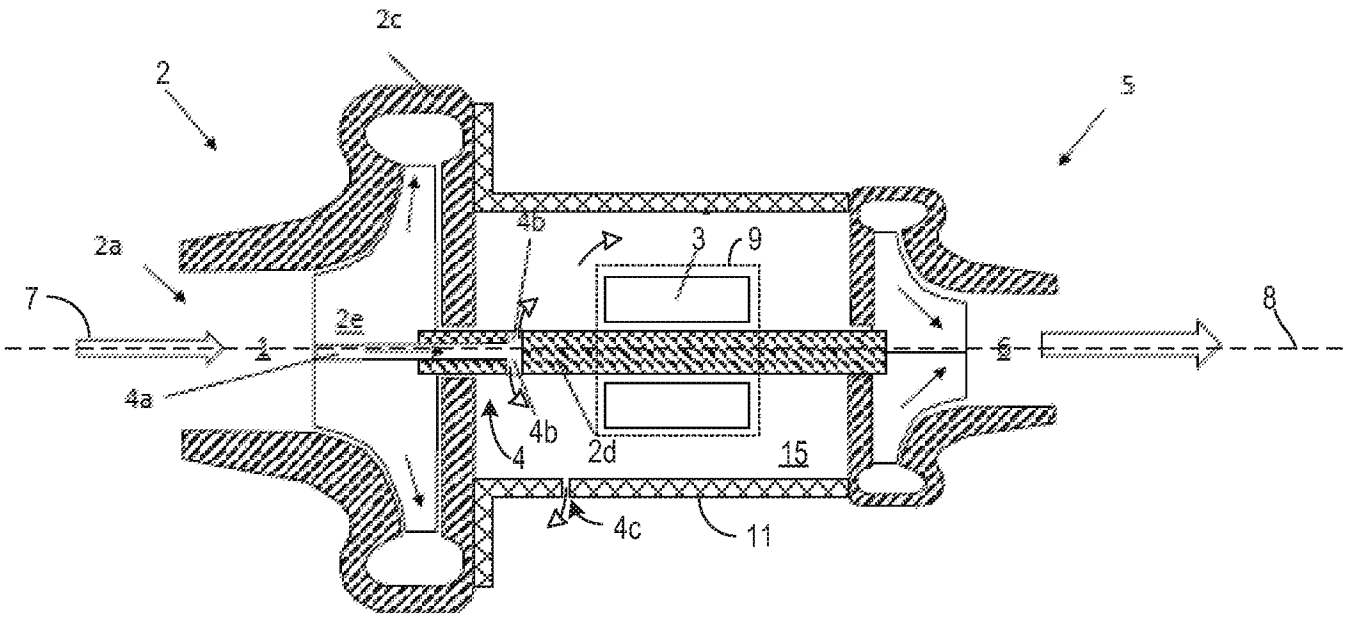
FIG. 1 shows, schematically and in a side view, the exhaust-gas turbocharger of an embodiment of the internal combustion engine, partially in section along the shaft of the exhaust-gas turbocharger.
Figure 2:
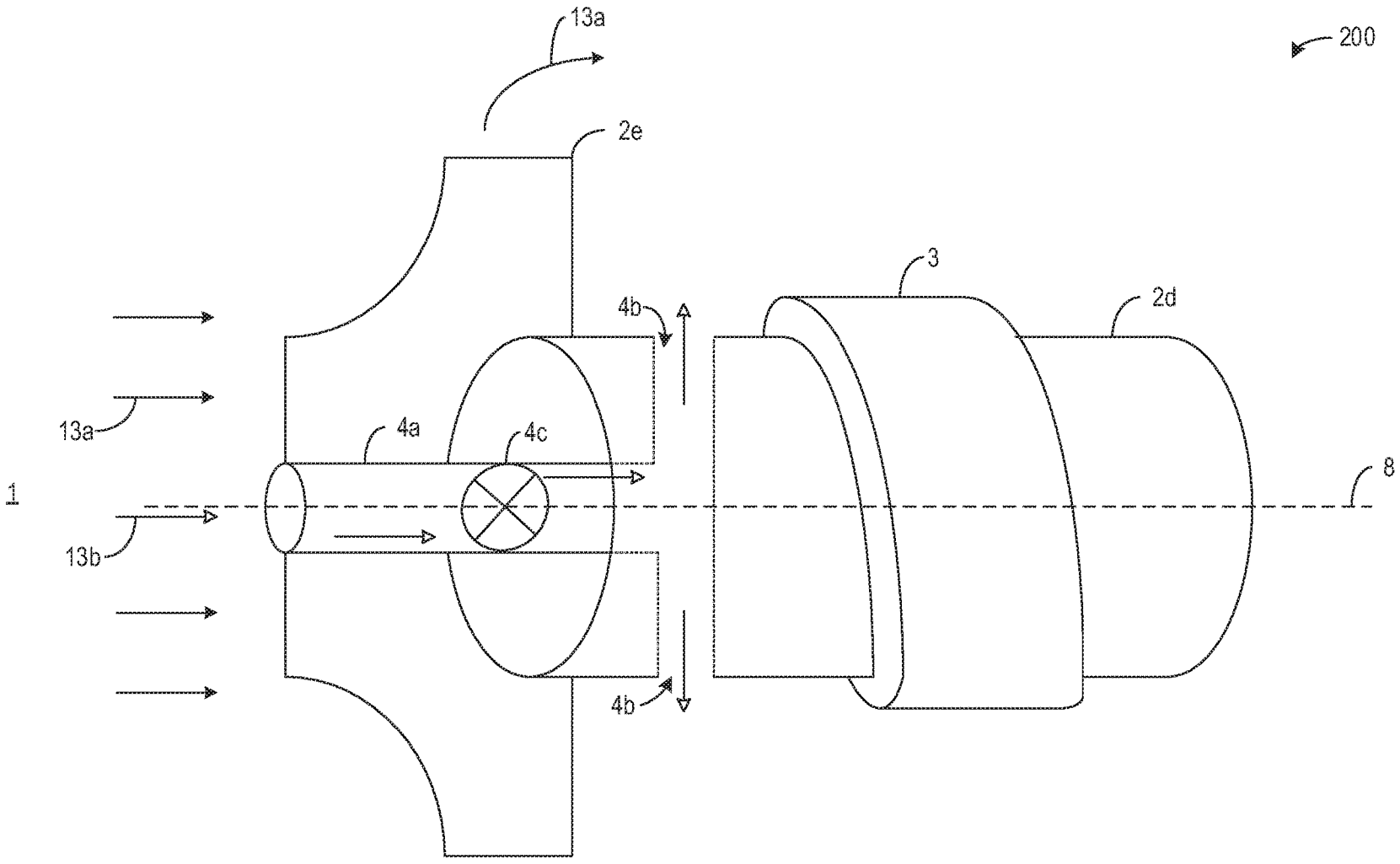
FIG. 2 shows an alternative view of the embodiment of FIG. 1.

A ventilation system may be arranged along the shaft, as shown in FIG. 1. The ventilation system may comprise a duct configured to admit air into the shaft and a plurality of outlets configured to release the air from the duct into a turbocharger housing. A detailed illustration of the ventilation system is shown in FIG. 2.

Figure 3:
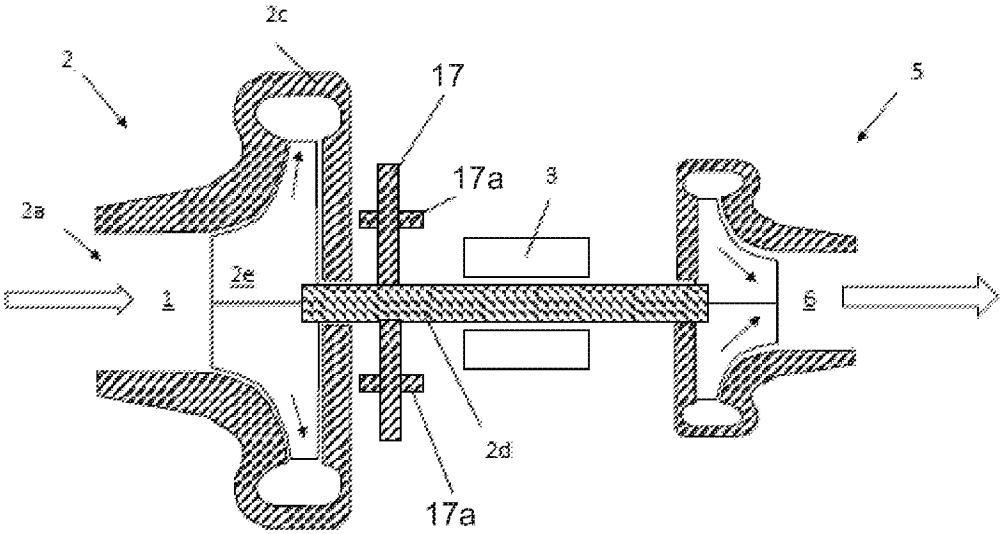
FIG. 3 shows, schematically and in a side view, the exhaust-gas turbocharger having a fan arranged along the shaft.

The shaft may additionally comprise a fan, such as the fan illustrated in FIG. 3. The fan may rotate proportionally to a rotation of the shaft such that the fan creates a cooling breeze onto the compressor housing.

Figure 4:
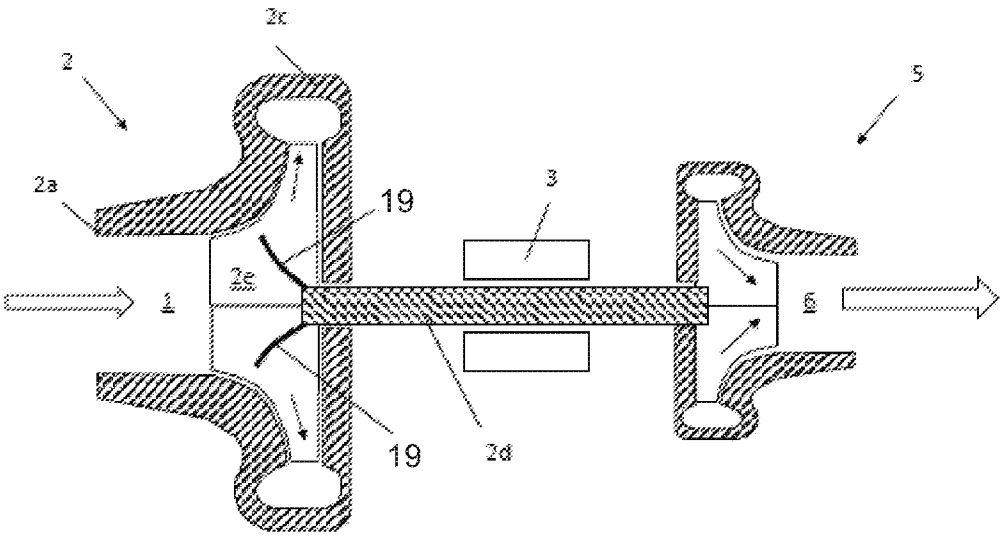
FIG. 4 shows, schematically and in a side view, the exhaust-gas turbocharger having a heat transfer material arranged in the compressor blades.

One or more heat conductors may be arranged along the compressor impeller, as shown in FIG. 4. The turbocharging system may be included in an engine system, such as the engine system of FIG. 5.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Note that FIGS. 1 and 2 show arrows indicating where there is space for gas to flow, and the solid lines of the device walls show where flow is blocked and communication is not possible due to the lack of fluidic communication created by the device walls spanning from one point to another. The walls create separation between regions, except for openings in the wall which allow for the described fluid communication.

Turning now to FIG. 1, it shows, schematically and in a side view, the exhaust-gas turbocharger of a first embodiment of the internal combustion engine, partially in section along the shaft 2*d* of the exhaust-gas turbocharger.

For the supply of the charge air to the cylinders, the internal combustion engine has an intake system 1. An exhaust-gas discharge system 6 serves for the discharge of the exhaust gases from engine cylinders.

For the supercharging of the internal combustion engine, an exhaust-gas turbocharger is provided which comprises a turbine 5 arranged in the exhaust-gas discharge system 6 and a compressor 2 arranged in the intake system 1, which turbine and compressor are arranged on the same shaft 2*d*. A bearing housing 3 arranged between turbine 5 and compressor 2 serves for the accommodation and mounting of the rotatable shaft 2*d* of the exhaust-gas turbocharger or compressor 2.

The compressor 2 may be a radial compressor, which comprises an impeller 2*e* mounted on the rotatable shaft 2*d*, which impeller is arranged in a compressor housing 2*c* and rotates during the operation of the compressor 2. The shaft 2*d* lies in the plane of the drawing of FIG. 1, and runs horizontally. Said another way, the shaft 2*d* extends in a direction along the central axis 8 substantially parallel to a direction of ambient air flow 7.

The compressor 2 of the exhaust-gas turbocharger has an inlet region 2*a* which runs, and is formed, coaxially with respect to the shaft 2*d* of the compressor 2, such that the section of the intake system 1 upstream of the compressor 2 does not exhibit any changes in direction, and the flow of charge air approaching the compressor 2 of the exhaust-gas turbocharger, or the impeller 2*e* thereof, runs substantially axially. Thus, ambient air may readily flow toward the impeller 2*e* without any turns or adjustments from its original direction of travel, parallel to the central axis 8.

Figure 6:
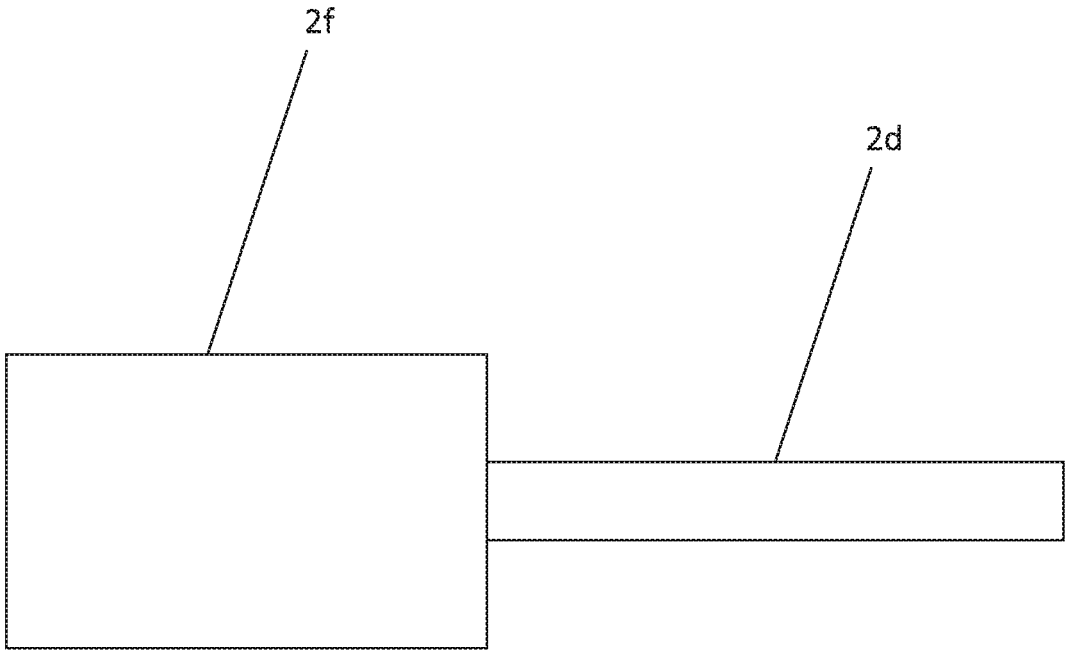
FIG. 6 shows a shaft 2*d* with a thickened end 2*f*.

The rotatable shaft 2*d* of the compressor 2 is equipped with a ventilation system 4 which comprises a duct 4*a* which opens into the intake system 1 at the compressor-side end side of the shaft 2*d* and is thereby connected to the intake system 1 upstream of the compressor 2, such that air from the intake system 1 can be fed into the duct 4*a* and the rest of the ventilation system 4. The rotatable shaft 2*d* may include a thickened end 2*f*, as depicted in FIG. 6

The duct 4*a* is of rectilinear form and runs coaxially with respect to the shaft 2*d* of the compressor 2, that is to say with respect to the axis of rotation (e.g., central axis 8) of the compressor 2.

Two lines 4*b* branch off from the duct 4*a*, which lines are likewise of rectilinear form. In the present case, the lines 4*b* run perpendicular to the duct 4*a* and are oriented radially outward, whereby the conveyance of air via the ventilation system 4 is intensified via centrifugal forces created by air flowing out of the duct 4*a* via the lines 4*b* during rotation of the shaft 2*d* and locomotion of a vehicle.

The lines 4*b* emerge from the shaft 2*d*, and open into the surroundings, between the compressor 2 and the bearing housing 3.

As it flows through the ventilation system 4, the air cools the shaft 2*d* of the compressor 2, wherein the temperature difference between the hot air in the impeller 2*e* and the relatively cool compressor shaft 2*d* forces the dissipation of heat from the charge air. It is sought to achieve as isothermic a compression as possible with high efficiency.

Said another way, each of the compressor 2 and the turbine 5 may be rotatably coupled to the shaft 2*d*. The turbine 6 may receive exhaust gases, where a turbine impeller rotates, translating to rotation of the shaft 2*d* and the compressor impeller 2*e*. As ambient air flows toward the compressor impeller 2*e* via the inlet region 2*a*, a first portion of ambient air which contacts the impeller may be compressed. A second portion of ambient air, which flows toward the compressor impeller 2*e*, but does not contact the impeller 2*e*, flows into the duct 4*a* of the ventilation system 4. The second portion of ambient air may be less than the first portion. The duct 4*a* may be arranged along geometric centers of the compressor impeller 2*e* and the shaft 2*d*, aligned with the central axis 8. The duct 4*a* may fluidly couple the ventilation system 4 to the intake system 1. Specifically, the duct 4*a* may fluidly couple an interior of the shaft 2*d* to the intake system 1. The duct 4*a* may extend to a portion of the shaft 2*d* upstream of the bearings 3 such that the duct 4*a* does not contact nor is surrounded by the bearings 3.

The air in the duct 4*a* may cool the shaft 2*d*. The shaft 2*d* may be heated due to high exhaust gas temperatures from the turbine 5. For example, the turbine 5 may be approximately 1000° C. and the compressor 2 may be approximately 100° C. Thus, the shaft 2*d* may transfer heat from the turbine 5 to parts of the compressor 2. For example, the shaft 2*d* may heat the compressor housing 2*c* and the compressor impeller 2*e*, thereby decreasing a compression efficiency. By flowing ambient air into the shaft 2*d* via the duct 4*a*, the ambient air may both reduce heat transfer from the turbine 5 to the compressor 2 and cool the compressor housing. The ambient air in the duct 4*a*, which is not compressed and comprises a pressure and temperature substantially equal to ambient air (e.g., 20-40° C.), may exit the duct 4*a* via lines in radially outward directions normal to the central axis 8 and contact the compressor housing 2*c*. Herein, lines 4*b* may be referred to as outlets 4*b*. Although only 2 outlets 4*b* are shown, there may be three or more outlets 4*b*. As shown, there are no other inlets or additional outlets of the ventilation arrangement than the duct 4*a* and the outlets 4*b*.

The outlets 4*b* may allow ambient air in the duct 4*a* to exit the shaft 2*d* and enter a space 15 in a turbocharger housing 11, in which the ambient air may contact the compressor housing 2*c*, contact oil passages 9 configured to cool the bearings 3, and/or flow through a bleed passage 4*c* arranged in the turbocharger housing. The bleed passage may flow the ambient air to an ambient atmosphere. In this way, there is space for air to flow between the shaft 2*d* and the turbocharger housing 11.

Turning now to FIG. 2, it shows an embodiment 200 illustrating the bearings 3, shaft 2*d*, and duct 4*a* in three dimensions. The impeller 2*e* is shown in two dimensions to make the relationships between the impeller 2*e*, the shaft 2*d*, and the duct 4*a* clearer. As such, components previously introduced may be similarly numbered herein and not reintroduced for reasons of brevity.

In the embodiment shown, the duct 4*a* and the outlets 4*b* are arranged along a portion of the shaft 2*d* upstream of the bearings 3. As shown, the outlets 4*b* are positioned such that they direct air from out of the duct 4*a* to a housing (e.g., housing 11 of FIG. 1) at a location upstream of the bearings 3.

Ambient air, shown via arrows 13*a* and 13*b*, flows from the intake system 1 toward the impeller 2*e*. Black head arrows 13*a* indicate ambient air flow flowing directly toward the impeller 2*e* and white head arrows 13*b* indicate ambient air flow flowing directly toward the duct 4*a*. As shown, the arrows 13*a* are distal to the central axis 8 and the arrows 13*b* are proximal to the central axis 8. In this way, black head arrows 13*a* may be compressed and white head arrows 13*b* may not be compressed. In one example, ambient air flowing into the duct 4*a* is not compressed and ambient air flowing to the impeller 2*e*, and not into the duct 4*a*, is compressed.

The duct 4*a* may rotate proportionally to a rotation of the shaft 2*d* as it receive ambient air (arrows 13*b*). The ambient air may flow directly into the duct 4*a* without turning or other form of protuberance to its original flow. The ambient air may continue to flow directly along the central axis 8 while in the duct 4*a* until it reaches outlets 4*b*. As the outlets 4*b*, the ambient air in the duct 4*a* may flow in a radially outward direction perpendicular to the central axis 8. This may be promoted via centrifugal forces generated during rotation of the shaft 2*d*. Thus, a vacuum effect may occur at an inlet of the duct 4*a*, near the intake system 1, such that air flow into the duct 4*a* is promoted. A combination of the air flowing into the duct 4*a*, which may reduce heat transfer between the shaft 2*d* and the impeller 2*e*, and the air flowing out of the outlets 4*b*, which may reduce an impeller temperature and temperatures of other components, may reduce an overall temperature of compressed air 13*a*.

In addition to cooling the compressed air, the ambient air flowing out of the duct 4*b* may further cool a fluid used to cool the bearings 3. For example, the air may come into contact with surfaces housing the fluid and may cool the fluid as the air flows across the surfaces. In this way, a temperature of the bearings 3 may also be decreased.

The embodiment 200 further comprises a shut-off element 4*c* arranged in the duct 4*a* upstream of the outlets 4*b*. The shut-off element 4*c* may be configured to actuate in response to instructions sent by a controller (e.g., controller 12 of FIG. 5) to an actuator of the shut-off element 4*c*. The shut-off element 4*c* may be adjusted to a fully closed position, a fully open position, and any position therebetween. The fully closed position may include where the shut-off element 4*c* prevents air from entering the duct 4*a*. The fully open position may include where the shut-off element 4*c* allows 100% air flow through the duct 4*a* such that air flow is uninterrupted. Thus, the positions between the fully open and fully closed positions may adjust an amount of air flowing into the duct 4*a*. In one example, the shut-off element 4*c* may be adjusted in response to a charge air temperature, charge air cooler activity (e.g., on/off), engine temperature, boost demand, and the like. For example, if the charge air temperature is too high (e.g., above 150° C.), then the shut-off element 4*c* may be actuated to an at least partially open position. Conversely, if charge air cooling is not desired and the temperature is between 100 to 150° C., then the shut-off element 4*c* may be adjusted to the fully closed position.

Turning now to FIG. 3, it shows, schematically and in a side view, the exhaust-gas turbocharger of a first embodiment of the internal combustion engine, partially in section along the shaft 2*d* of the exhaust-gas turbocharger.

The rotatable shaft 2*d* of the compressor 2 is equipped with a fan wheel 17 which is mounted on the shaft 2*d* and which rotates when the compressor 2 is in operation and the shaft 2*d* is in rotation.

The fan wheel 17 has a multiplicity of vanes 17*a* and is arranged at the compressor side between the compressor housing 2*c* and the bearing housing 3. An air flow generated by the rotating fan wheel 17 is conducted over the housing 2*c*, wherein the air flow is indicated in FIG. 3 by double arrows. The air flow extracts heat from the housing 2*c* by convection and dissipates said heat to the surroundings. Here, the air flow cools the housing 2*c* of the compressor 2.

The temperature difference between the hot charge air in the impeller 2*e* and the relatively cool fan wheel 4 also ensures an increased dissipation of heat from the charge air via impeller 2*e*, shaft 2*d* and fan wheel 17. It is sought to achieve as isothermic a compression as possible with high efficiency.

Turning now to FIG. 4, it shows, schematically and in a side view, the exhaust-gas turbocharger of a first embodiment of the internal combustion engine, partially in section along the shaft 2*d* of the exhaust-gas turbocharger.

The impeller 2*e* of the compressor 2 is equipped with multiple heat conductors 19 which are arranged in the manner of a spider and which run in stellate fashion from the edges of the impeller blades toward the shaft 2*d*. Said heat conductors 19 serve for the improved dissipation of heat from the impeller 2*e* and from the charge air that flows through the impeller 2*e* during the course of the compression. It is sought to achieve as isothermic a compression as possible with high efficiency.

Thus, FIGS. 1, 3, and 4 show various embodiments of devices which may be used to achieve isothermic compression. It will be appreciated that the embodiments of the FIGS. 1, 3, and 4 may be combined without departing from the scope of the present disclosure. For example, a turbocharger may comprise the ventilation system 4 of FIG. 1 and the fan 17 of FIG. 3. In one example, the fan 17 and the outlets 4*b* of the ventilation system 4 may operate synergistically such that the fan 17 may assist the air from the outlets 4*b* to cool the compressor 2 and the charge air flowing therefrom. Additionally or alternatively, the heat conductors of FIG. 4 may be included with one or more of the fan 17 and ventilation system 4 to provide further cooling of the compressor.

Figure 5:
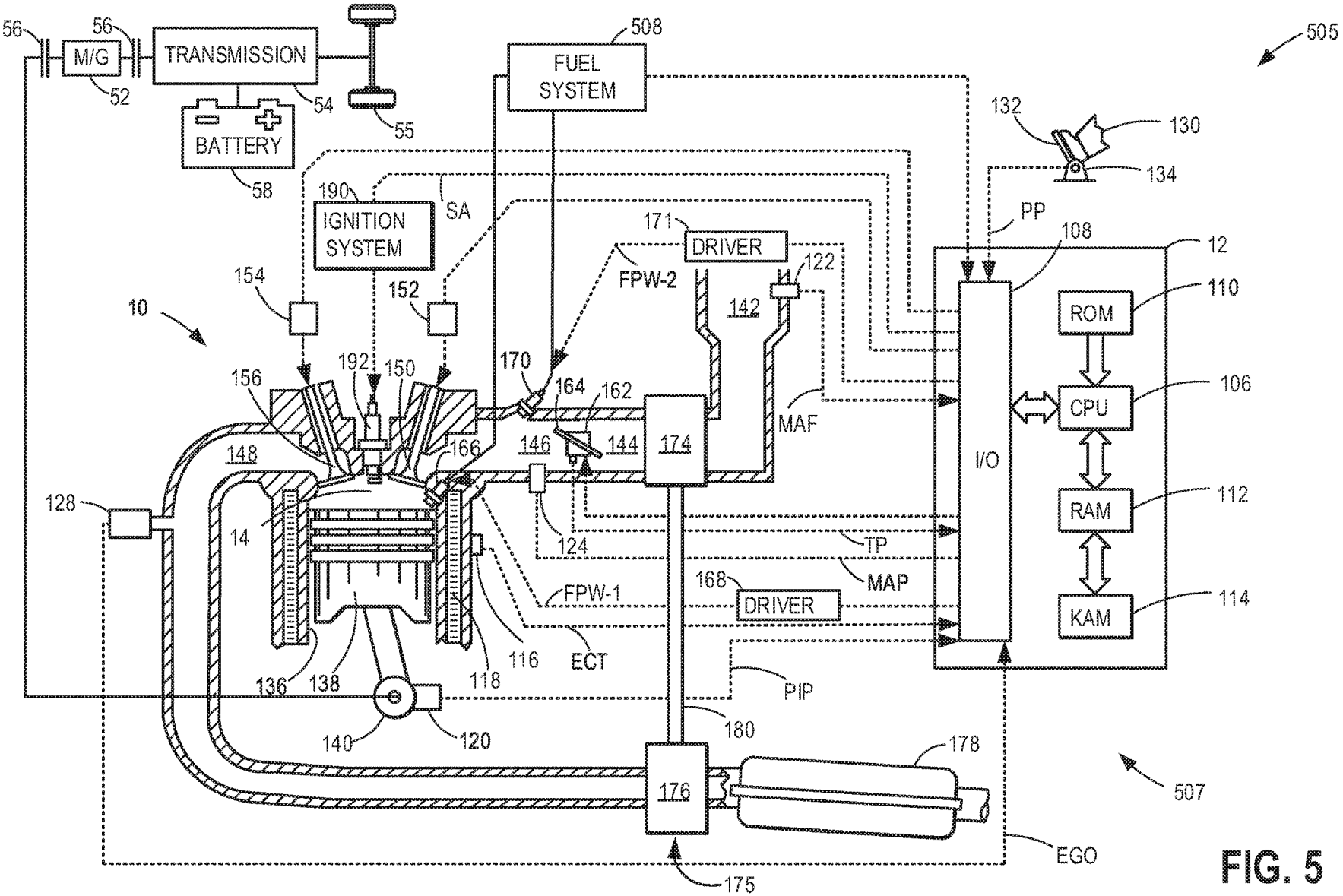
FIG. 5 shows a vehicle having an engine configured to utilize the exhaust-gas turbocharger of FIGS. 1 through 4.

FIG. 5 depicts an example of a cylinder of internal combustion engine 10 included by engine system 507 of vehicle 5. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (which may be referred to herein as a combustion chamber) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. FIG. 1 shows engine 10 configured with a turbocharger 175 including a compressor 174 arranged between intake passages 142 and 144, and an exhaust turbine 176 arranged along exhaust passage 148. In one example, the compressor 174, the turbine 176, and a shaft 180 are used similarly to the compressor 2, turbine 5, and the shaft 2*d* of FIGS. 1, 3, and 4. Compressor 174 may be at least partially powered by exhaust turbine 176 via the shaft 180. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 508. Fuel system 508 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 508 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 508, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 508 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 505 may be a hybrid vehicle with multiple sources of torque available to one or more vehicle wheels 55. In other examples, vehicle 505 is a conventional vehicle with only an engine. In the example shown, vehicle 505 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

In this way, the compressor shaft may comprise a duct configured to allow ambient air into the shaft to decrease a temperature of the compressor. The duct may mitigate heat transfer along the shaft from the turbine to the compressor. Outlets of the duct may be oriented to direct air out of the duct toward the compressor housing. The technical effect of including the duct in the shaft is to decrease compression temperatures to increase engine power output and increase compression efficiency.

A supercharged internal combustion engine comprises an intake system for the supply of a charge-air flow, an exhaust-gas discharge system for the discharge of exhaust gas, at least one compressor arranged in the intake system, which compressor comprises at least one impeller which is mounted, in a compressor housing, on a rotatable shaft, and a bearing housing for the accommodation and mounting of the rotatable shaft of the at least one compressor, and where the rotatable shaft of the at least one compressor is equipped with a ventilation system which comprises at least one duct which is formed so as to be open to the intake system upstream of the at least one compressor and from which at least one line branches off which emerges from the shaft between the at least one compressor and the bearing housing. A first example of the engine further includes where the at least one duct opens out into the intake system at a compressor-side end side of the shaft. A second example of the engine, optionally including the first example, further includes where the at least one duct is of rectilinear form and is coaxial with the shaft. A third example of the engine, optionally including the first and/or second examples, further includes where the at least one line is of rectilinear form and extends in a radially outward direction perpendicular to the duct and the shaft. A fourth example of the engine, optionally including one or more of the first through third examples, further includes where the shaft has, at the impeller side, a thickened shaft end for accommodating the at least one impeller. A fifth example of the engine, optionally including one or more of the first through fourth examples, further includes where the at least one compressor which can be driven by means of an auxiliary drive is arranged in the intake system. A sixth example of the engine, optionally including one or more of the first through fifth examples, further includes where the at least one compressor is included in an exhaust-gas turbocharger provided with a turbine arranged in the exhaust-gas discharge system and the compressor being arranged in the intake system. A seventh example of the engine, optionally including one or more of the first through sixth examples, further includes where the ventilation system is equipped with a shut-off element.

A system comprises a turbocharger comprising a compressor and a turbine rotatably coupled to a shaft, and where the shaft further comprises a ventilation system comprising a duct configured to allow air to enter an interior of the shaft. A first example of the system further includes where the compressor is arranged in an intake system, and where the duct receives ambient air from upstream of an impeller of the compressor relative to a direction of ambient air flow. A second example of the system, optionally including the first example, further includes where the duct extends along a central axis of the compressor and the shaft, and where the duct extends through an impeller of the compressor. A third example of the system, optionally including the first and/or second examples, further includes where air in the duct is not compressed. A fourth example of the system, optionally including one or more of the first through third examples, further includes where a bearing housing being arranged on the shaft, and where the duct is arranged between the compressor and the bearings. A fifth example of the system, optionally including one or more of the first through fourth examples, further includes where a plurality of outlets configured to expel air from the duct and a space within the turbocharger housing, wherein the outlets are arranged upstream of the bearings. A sixth example of the system, optionally including one or more of the first through fifth examples, further includes where air inside the ventilation system does not contact and mix with air compressed by the impeller.

A turbocharging system comprises a compressor arranged in an intake system and a turbine arranged in an exhaust system, the compressor and the turbine being mechanically coupled via a rotatable shaft and a ventilation system arranged in a compressor side of the shaft configured to admit air from the intake system to an interior portion of the shaft, upstream of a bearing housing relative to a direction of air flow. A first example of the turbocharging system further includes where the ventilation system comprises a duct arranged along a central axis of the shaft, the duct further arranged along a central portion of a compressor impeller, where the duct is configured to admit air flowing proximally to the central axis of the shaft. A second example of the turbocharging system, optionally including the first example, further includes where the ventilation system comprises one or more outlets arranged between the compressor and the bearing housing, the outlets extending in radially outward directions, and where the outlets are configured to discharge air to a space within a turbocharger housing such that the air may contact a compressor housing and an oil passage housing, where the oil passage housing surrounds the bearing housing. A third example of the turbocharging system, optionally including the first and/or second examples, further includes where the turbocharger housing further comprises a bleed passage to expel air from the space to an ambient atmosphere. A fourth example of the turbocharging system, optionally including one or more of the first through third examples, further includes where there are no additional inlets or outlets to the ventilation system other than the duct and the one or more outlets.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A supercharged internal combustion engine comprising:

an intake system for supply of a charge-air flow, an exhaust-gas discharge system for discharge of exhaust gas, at least one compressor arranged in the intake system, the compressor comprising at least one impeller mounted in a compressor housing on a rotatable shaft, and a bearing housing for accommodation and mounting of the rotatable shaft of the at least one compressor, the rotatable shaft of the at least one compressor equipped with a ventilation system which comprises a duct extending from an opening in the intake system upstream of the at least one compressor to at least one outlet, the at least one outlet branches off from the duct and exhausts intake gas drawn from the intake system into an air space contacting the compressor housing and the bearing housing, and a shut-off element positioned within the duct within the rotatable shaft.

2. The supercharged internal combustion engine of claim 1, wherein the rotatable shaft has, at an impeller side, a thickened shaft end for accommodating the at least one impeller.

3. The supercharged internal combustion engine of claim 1, wherein the at least one compressor is included in an exhaust-gas turbocharger provided with a turbine arranged in the exhaust-gas discharge system and the compressor being arranged in the intake system.

4. A system comprising:

an engine including an intake system;

a turbocharger comprising a compressor, a compressor housing, and a turbine rotatably coupled to a shaft;

a ventilation system comprising a duct with an opening to draw air from the intake system into the duct in an interior of the shaft and outlets extending radially from the duct to exhaust the air into an air space contacting the compressor housing; and a fan mounted to the shaft outside of the compressor housing and the fan draws gas from the outlets and passes the gas over the compressor housing.

5. The system of claim 4, wherein the compressor is arranged in the intake system, and where the duct receives ambient air from upstream of an impeller of the compressor relative to a direction of ambient air flow and the air exhausted from the outlets contacts the compressor housing.

6. The system of claim 4, further comprising a bearing housing being arranged on the shaft, and where the outlets are arranged between the compressor and bearings.

7. The system of claim 6, further comprising a space within a turbocharger housing which receives the exhausted gas from the outlets.

8. A turbocharging system comprising:

a compressor arranged in an intake system and a turbine arranged in an exhaust system, the compressor and the turbine being mechanically coupled via a rotatable shaft;

a ventilation system arranged in a compressor side of the shaft with an opening to draw air from the intake system to an interior portion of the shaft and outlets to exhaust the air from the intake system from the shaft into an air space contacting a compressor housing; and a bleed passage in a turbocharger housing connecting the air space to atmosphere.

9. The turbocharging system of claim 8, wherein one or more outlets are arranged between the compressor and a bearing housing, the outlets extending in radially outward directions, and where the outlets are configured to discharge air to a space within the turbocharger housing such that the air contacts a compressor housing and an oil passage housing, where the oil passage housing surrounds the bearing housing.

10. The turbocharging system of claim 9, wherein the turbocharger housing further comprises the bleed passage to expel air from the space to an ambient atmosphere.

11. The turbocharging system of claim 9, wherein there are no additional inlets or outlets to the ventilation system other than a duct and the one or more outlets.

12. The supercharged internal combustion engine of claim 1, further comprising a fan mounted to the rotatable shaft between the compressor housing and the bearing housing and the fan draws gas from the at least one outlet and passes the gas over the compressor housing.

13. The supercharged internal combustion engine of claim 12, further comprising heat conductors extending radially inward along blades of the impeller towards the rotatable shaft.

14. The system of claim 4, further comprising heat conductors extending radially inward along blades of an impeller of the compressor towards the shaft.

15. The turbocharging system of claim 8, further comprising a fan mounted to the rotatable shaft outside of the compressor housing and the fan draws gas from the outlets and passes the gas over the compressor housing.

16. The turbocharging system of claim 8, further comprising heat conductors extending radially inward along blades of an impeller of the compressor towards the rotatable shaft.

17. The system of claim 4, wherein the outlets rotate with the shaft and the fan and rotating outlets synergistically draw air from the outlets.

* * * * *